US009505475B2

(12) United States Patent
Harada

(10) Patent No.: US 9,505,475 B2
(45) Date of Patent: Nov. 29, 2016

(54) JET PROPELLED WATERCRAFT

(71) Applicant: YAMAHA HATSUDOKI KABUSHIKI KAISHA, Iwata-shi, Shizuoka (JP)

(72) Inventor: Naoki Harada, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/685,678

(22) Filed: Apr. 14, 2015

(65) Prior Publication Data

US 2016/0031538 A1 Feb. 4, 2016

(30) Foreign Application Priority Data

Aug. 1, 2014 (JP) ..... 2014-158129

(51) Int. Cl.

| | |
|---|---|
| ***B63H 21/14*** | (2006.01) |
| ***B63H 21/30*** | (2006.01) |
| ***B63B 35/73*** | (2006.01) |
| ***B63H 11/04*** | (2006.01) |

(52) U.S. Cl.

CPC ..... *B63H 21/14* (2013.01); *B63B 35/731* (2013.01); *B63H 11/04* (2013.01); *B63H 21/305* (2013.01)

(58) Field of Classification Search

CPC ..... B63H 21/14; B63B 35/731
USPC ..... 440/38, 111
See application file for complete search history.

(56) References Cited

U.S. PATENT DOCUMENTS

| | | | | |
|---|---|---|---|---|
| 4,765,075 | A * | 8/1988 | Nakase | B63B 35/731 114/55.5 |
| 4,778,421 | A * | 10/1988 | Greenberg | B63H 21/305 248/671 |
| 5,509,837 | A * | 4/1996 | Allbright, Jr. | B63H 21/305 248/659 |
| 5,695,371 | A * | 12/1997 | Katoh | B63H 21/305 440/111 |
| 6,386,931 | B1 * | 5/2002 | Nanami | B63H 21/30 114/55.5 |
| 6,415,728 | B1 * | 7/2002 | Maeda | B63B 3/70 114/357 |
| 2006/0065230 | A1 * | 3/2006 | Hoi | F01M 5/007 123/196 AB |
| 2016/0031538 | A1 * | 2/2016 | Harada | B63H 21/305 440/38 |

FOREIGN PATENT DOCUMENTS

JP 08-175496 A 7/1996

* cited by examiner

*Primary Examiner* — Lars A Olson
*Assistant Examiner* — Jovon Hayes
(74) *Attorney, Agent, or Firm* — Keating and Bennett, LLP

(57) ABSTRACT

A jet propelled watercraft includes a front stopper that is disposed between a hull and an engine, that faces the hull across a space therebetween in an up-down direction, and that is made of an elastic material. The engine includes a crankshaft rotatable around a crankshaft axis, a crankcase that houses the crankshaft, a case cover attached to the crankcase, and a stopper attachment portion that is integral and unitary with the case cover and to which the front stopper is attached.

9 Claims, 8 Drawing Sheets

JET PROPELLED WATERCRAFT

BACKGROUND OF THE INVENTION

1. Field of the Invention

The present invention relates to a jet propelled watercraft.

2. Description of the Related Art

In a jet propelled watercraft, an engine is supported by a hull via a plurality of dampers. There is an instance in which the engine approaches the hull because of the elastic deformation of the dampers when the jet propelled watercraft rapidly moves in an up-down direction during traveling. In this instance, a stopper made of an elastic material is disposed between the hull and the engine in order to restrict the movement of the engine with respect to the hull.

The stopper is held by one of the hull and the engine, and is spaced apart from the other one of the hull and the engine when the jet propelled watercraft is in a static state. When the engine approaches the hull because of the elastic deformation of the dampers, the stopper comes into contact with both the hull and the engine and restricts the movement of the engine with respect to the hull. Additionally, the engine comes into contact with the hull via the stopper, and thus, a shock to the hull is reduced.

In a jet propelled watercraft disclosed in Japanese Unexamined Patent Publication No. H8-175496, a mount body made of an aluminum alloy is fixed to a crankcase via four bolts, and a stopper made of synthetic rubber is attached to the mount body via two bolts. Therefore, the stopper is attached to the engine via the mount body that is a component structurally independent of the engine. Therefore, the number of components and the number of assembling process steps of the jet propelled watercraft increase.

SUMMARY OF THE INVENTION

In order to overcome the previously unrecognized and unsolved challenges described above, a preferred embodiment of the present invention provides a jet propelled watercraft including a jet pump configured to jet water rearwardly, an engine configured to drive the jet pump, a hull housing the engine, and a stopper that is disposed between the hull and the engine, that faces the hull across a space between the stopper and the hull in an up-down direction, and that made of an elastic material. The engine includes a crankshaft configured to rotate around a crankshaft axis, a crankcase housing the crankshaft, a case cover attached to the crankcase, and a stopper attachment portion that is integral and unitary with the crankcase or with the case cover and to which the stopper is attached.

According to this arrangement, the stopper made of an elastic material is disposed between the hull and the engine. The stopper faces the hull across a space therebetween in the up-down direction. The stopper is attached to the stopper attachment portion that is integral and unitary with the crankcase or with the case cover. Therefore, a structurally independent member through which the stopper is attached to the engine is unnecessary, and it is possible to reduce the number of components and the number of assembling process steps. Additionally, such a member is unnecessary, and thus, it is possible to prevent components, such as the engine, that are housed in the hull from being enlarged.

In a preferred embodiment of the present invention, the engine preferably further includes a flywheel configured to rotate around the crankshaft axis together with the crankshaft. The case cover preferably includes a wheel housing portion housing the flywheel. In this instance, the stopper attachment portion is preferably integral and unitary with the wheel housing portion.

In a preferred embodiment of the present invention, the stopper is preferably disposed at a more forward position than the flywheel.

The engine is preferably supported by the hull via four dampers, for example, disposed at four places spaced apart in the frontward, rearward, rightward, and leftward directions. Additionally, the engine is connected to the jet pump disposed behind the engine. Therefore, it is more difficult for the rear end of the engine to move with respect to the hull than the front end of the engine. The stopper is disposed at a more forward position than the flywheel. In other words, the stopper is disposed near the front end of the engine that is likely to move more easily with respect to the hull as compared with the rear end of the engine. Therefore, it is possible to effectively restrict the movement of the engine with respect to the hull.

In a preferred embodiment of the present invention, the stopper attachment portion preferably extends forwardly from the wheel housing portion.

According to this arrangement, at least one portion of the stopper attachment portion is disposed at a more forward position than the wheel housing portion. Therefore, the stopper and the stopper attachment portion are disposed near the front end of the engine that is more easily moved compared to the rear end of the engine. Therefore, it is possible to effectively restrict the movement of the engine with respect to the hull.

In a preferred embodiment of the present invention, the stopper attachment portion is preferably disposed at a more forward position than the crankcase.

According to this arrangement, it is possible to increase the distance from the gravity center of the engine to the stopper in the front-rear direction. When the distance from the gravity center of the engine to the stopper is great, it is possible to restrict the movement of the engine with a smaller force. Therefore, it is possible to more reliably restrict the movement of the engine with respect to the hull.

In a preferred embodiment of the present invention, the jet propelled watercraft preferably further includes a damper attached to both the hull and the engine. The case cover preferably includes a damper attachment portion to which the damper is attached. In this instance, the stopper attachment portion is preferably integral and unitary with the damper attachment portion.

In a preferred embodiment of the present invention, the engine preferably further includes an intake device configured to supply air to a combustion chamber. The case cover preferably includes a support portion that supports the intake device. In this instance, the stopper attachment portion is preferably integral and unitary with the support portion.

According to this arrangement, the intake device is supported by the support portion of the case cover. Therefore, not only the mass of the case cover itself but also the mass of the intake device is applied to the case cover. The stopper attachment portion is integral and unitary with the support portion of the case cover. Therefore, the stopper is attached to a portion to which a comparatively great inertia force is applied when the jet propelled watercraft rapidly moves in the up-down direction during traveling. Therefore, it is possible to prevent a great shock from hitting the hull when the engine comes into contact with the hull via the stopper.

In a preferred embodiment of the present invention, the intake device preferably includes an air intake box containing an air filter. A portion of the air intake box is preferably supported by the support portion of the case cover.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Frontward, rearward, upward, downward, rightward, and leftward directions mentioned in the following description are with reference to a hull 7. The term "body center WO" denotes a vertical plane passing through a bow and through a stern center. The term "outward" denotes a direction receding from the body center WO in a width direction (right-left direction).

Figure 1:
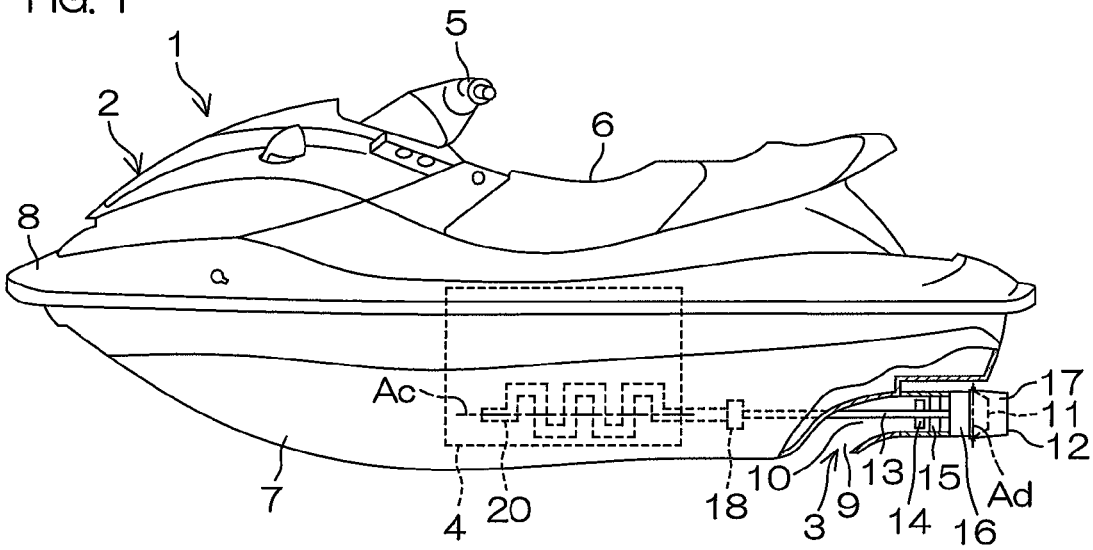
FIG. 1 is a schematic view showing a left side of a jet propelled watercraft according to a preferred embodiment of the present invention.

FIG. 1 is a schematic view showing a left side of a jet propelled watercraft according to a preferred embodiment of the present invention.

As shown in FIG. 1, the jet propelled watercraft 1 includes a body 2 floating on the water, a jet pump 3 configured to propel the body 2, and an engine 4 configured to drive the jet pump 3. The jet propelled watercraft 1 additionally includes a handle 5 that is operated rightwardly and leftwardly by a crew member and a seat 6 on which a crew member sits.

The body 2 includes a hull 7 floating on the water and a deck 8 disposed at a higher position than a water surface. The deck 8 is disposed above the hull 7 that defines the bottom of the watercraft. The engine 4 is disposed between the hull 7 and the deck 8 in an up-down direction. The engine 4 is disposed in an engine room inside the body 2. The jet pump 3 is disposed behind the engine 4. The seat 6 is disposed above the engine 4. The handle 5 is disposed at a more forward position than a seating surface of the seat 6. The handle 5 and the seat 6 are disposed above the body 2.

The jet pump 3 includes an intake 9 that opens at the bottom of the watercraft, an outlet 11 through which water sucked into the intake 9 is jetted rearwardly, and a flow passage 10 that guides water sucked into the intake 9 to the outlet 11. The jet pump 3 additionally includes an impeller 14 and a stationary blade 15 both of which are disposed in the flow passage 10, a drive shaft 13 configured to rotate together with the impeller 14, a nozzle 16 that defines the outlet 11, and a deflector 17 that rightwardly and leftwardly tilts the direction of a water flow that is jetted rearwardly from the nozzle 16.

The front end of the drive shaft 13 is disposed in the engine room, and the rear end of the drive shaft 13 is disposed in the flow passage 10. The front end of the drive shaft 13 is connected to the engine 4 via a coupling 18. The nozzle 16 is fixed to the body 2, and does not move with respect to the body 2. The deflector 17 is connected to the nozzle 16, and is configured to turn rightwardly and leftwardly with respect to the nozzle 16 around a deflector axis Ad that extends in the up-down direction. The deflector 17 turns rightwardly and leftwardly in accordance with the operation of the handle 5. The outlet 11 of the nozzle 16 is disposed in the deflector 17. The deflector 17 defines a jet opening 12 that is open rearwardly. The jet opening 12 is disposed behind the outlet 11.

The output of the engine 4 is adjusted by a throttle lever disposed at the handle 5 and operated by a crew member. When the engine 4 rotates the drive shaft 13, the impeller 14 rotates around the center line of the drive shaft 13, thus generating a sucking force by which outboard water is sucked into the flow passage 10 from the intake 9. Water sucked into the flow passage 10 passes through the impeller 14, the stationary blade 15, the nozzle 16, and the deflector 17 in this order, and is jetted rearwardly from the jet opening 12 of the deflector 17. As a result, a thrust by which the jet propelled watercraft 1 is propelled forwardly is generated. Additionally, the deflector 17 turns rightwardly and leftwardly in accordance with the operation of the handle 5, and thus, the direction of water jetted from the jet pump 3 is changed rightwardly and leftwardly in accordance with the operation of the handle 5. As a result, the jet propelled watercraft 1 is steered.

Figure 3:
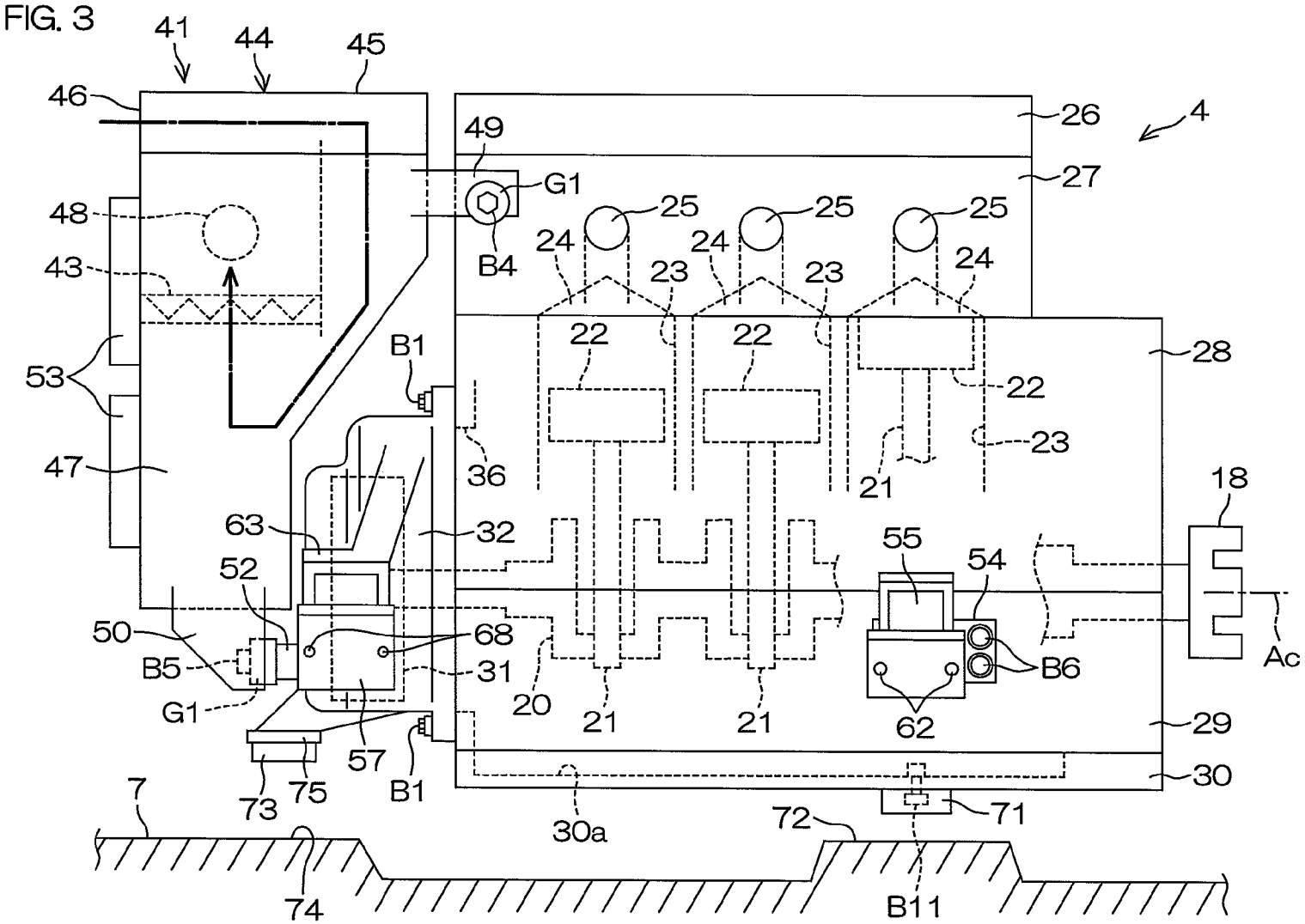
FIG. 3 is a schematic view showing a left side of an engine mounted in the jet propelled watercraft.

As shown in FIG. 3, the engine 4 is preferably an internal combustion engine. The engine 4 may be a straight type engine or may be a V type engine or may be an engine other than the straight type or V type engine. The engine 4 includes a crankshaft 20 configured to rotate around a crankshaft axis Ac that extends in the front-rear direction, a plurality of (e.g., three) pistons 22 that reciprocate in the up-down direction in accordance with the rotation of the crankshaft 20, a plurality of connecting rods 21 by which each piston 22 is connected to the crankshaft 20, and a flywheel 31 configured to rotate around the crankshaft axis Ac together with the crankshaft 20.

The engine 4 includes a cylinder body 28 including a plurality of cylinders 23 containing a plurality of pistons 22, respectively, a cylinder head 27 in which a plurality of combustion chambers 24, a plurality of exhaust ports 25, and a plurality of intake ports are disposed, a head cover 26 with which the cylinder head 27 is covered, and a crankcase 29 that contains the crankshaft 20 along with the cylinder body 28. The engine 4 additionally includes an oil pan 30 that stores lubrication oil that is supplied to movable portions, such as the crankshaft 20, of the engine 4 and a case cover 32 that contains the flywheel 31. The oil pan 30 includes a storage portion **30*a*** that stores lubrication oil.

The head cover 26, the cylinder head 27, the cylinder body 28, the crankcase 29, and the oil pan 30 are arranged in this order from a top side in the up-down direction. The case cover 32 is preferably disposed at a more forward position than the head cover 26, the cylinder head 27, the cylinder body 28, the crankcase 29, and the oil pan 30. The case cover 32 is preferably disposed at a lower position than the cylinder head 27. The crankshaft 20 protrudes forwardly and rearwardly from the cylinder body 28 and the crankcase 29. The flywheel 31 is connected to the front end of the crankshaft 20, and the coupling 18 is connected to the rear end of the crankshaft 20. The flywheel 31 and the coupling 18 are disposed on the crankshaft axis Ac.

Figure 2:
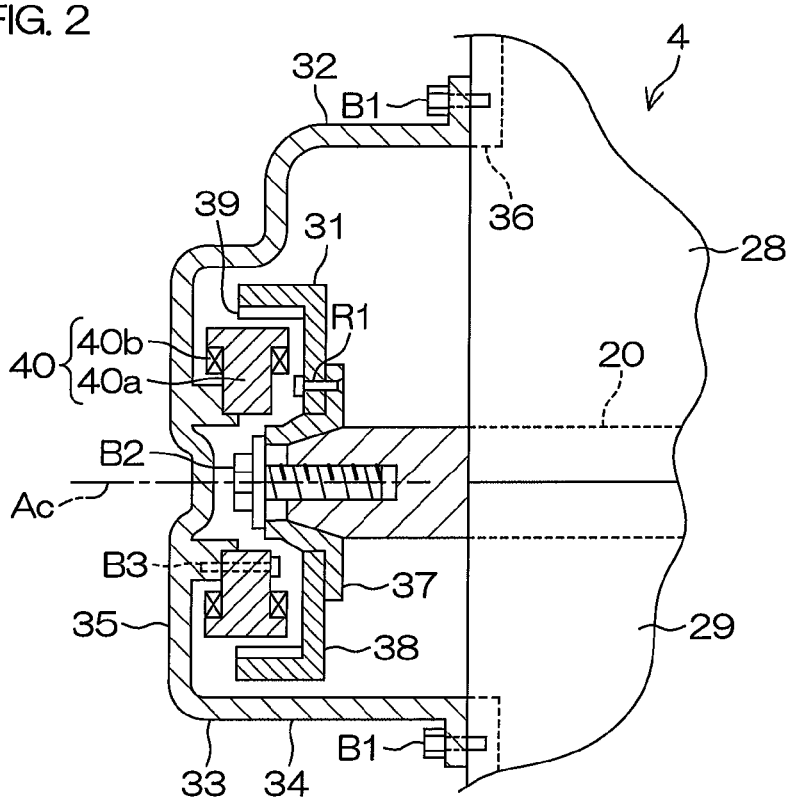
FIG. 2 is a schematic view showing a cross-section of a crankshaft, a flywheel, and a case cover along a vertical plane.

FIG. 2 shows a cross-section when the case cover 32 and so forth are cut by a vertical plane along the crankshaft axis Ac. As shown in FIG. 2, the case cover 32 includes a wheel housing portion 33 that houses the flywheel 31. The wheel housing portion 33 includes a cylindrical peripheral wall 34 that surrounds the flywheel 31 and a front wall 35 with which the front end of the peripheral wall 34 is closed. The wheel housing portion 33 is preferably fixed to the cylinder body 28 and to the crankcase 29 via, for example, a plurality of bolts B1, respectively. The wheel housing portion 33 covers the entire opening 36, which opens at the front surface of the cylinder body 28 and the front surface of the crankcase 29, from in front of the cylinder body 28 and the crankcase 29. The crankshaft 20 passes through the opening 36, and protrudes forwardly from the cylinder body 28 and the crankcase 29. The front end of the crankshaft 20 is disposed in the wheel housing portion 33.

The engine 4 includes an electric generator configured to convert the power of the engine 4 into electric power. As shown in FIG. 2, the electric generator includes an annular rotor 39 that rotates around the crankshaft axis Ac together with the flywheel 31 and an annular stator 40 fixed to the case cover 32. In other words, the engine 4 includes a flywheel magneto that includes the flywheel 31 and a portion (rotor 39) of the electric generator. When the crankshaft 20 rotates, the rotor 39 rotates together with the flywheel 31, and the rotor 39 and the stator 40 relatively rotate. As a result, the rotation of the engine 4 is converted into electric power.

As shown in FIG. 2, the rotor 39 and the stator 40 are housed in the wheel housing portion 33 of the case cover 32 along with the flywheel 31. The flywheel 31 includes an annular base ring 37 fixed to the crankshaft 20 preferably via a bolt B2, for example, and an annular holder 38 fixed to the base ring 37 via a rivet R1, for example. A permanent magnet of the rotor 39 is held on the inner peripheral surface of the holder 38. The rotor 39 surrounds the stator 40 across a space therebetween in a radial direction. The stator 40 includes a core 40*a* fixed to the case cover 32 preferably via a bolt B3, for example, and a plurality of coils 40*b* wound around the core 40*a*.

As shown in FIG. 3, the engine 4 includes an intake device 41 configured to supply air to a plurality of combustion chambers 24 via a plurality of intake ports. The intake device 41 includes an air intake box 44 containing an air filter 43 and an intake pipe 42 (see FIG. 5) configured to guide air discharged from the air intake box 44 to the combustion chambers 24. The intake device 41 additionally includes a throttle valve (not shown) configured to adjust the flow rate of air supplied from the intake pipe 42 to the combustion chambers 24 and an intake manifold (not shown) configured to guide air from the throttle valve to the combustion chambers 24. Air from which foreign substances have been removed by the air filter 43 is supplied to the combustion chambers 24 via the intake pipe 42, the throttle valve, and the intake manifold in this order.

As shown in FIG. 3, the air intake box 44 includes a box body 45 that contains the air filter 43. The box body 45 includes an intake-air inlet 46 that defines an opening in the upper portion of the front of the box body 45, an intake-air outlet 48 through which air sucked into the intake-air inlet 46 is discharged, and an intake passage 47 by which the intake-air inlet 46 and the intake-air outlet 48 are connected together. In FIG. 3, the flow of air is shown by the alternate long and short dash thick line. The air filter 43 is disposed in the intake passage 47. The box body 45 is disposed in front of the cylinder head 27, the cylinder body 28, and the crankcase 29. The rear end of the box body 45 is disposed above the case cover 32. The lower end of the box body 45 is disposed in front of the case cover 32. The box body 45 overlaps with the case cover 32 both when viewed in plan and when viewed from the front.

Figure 4:
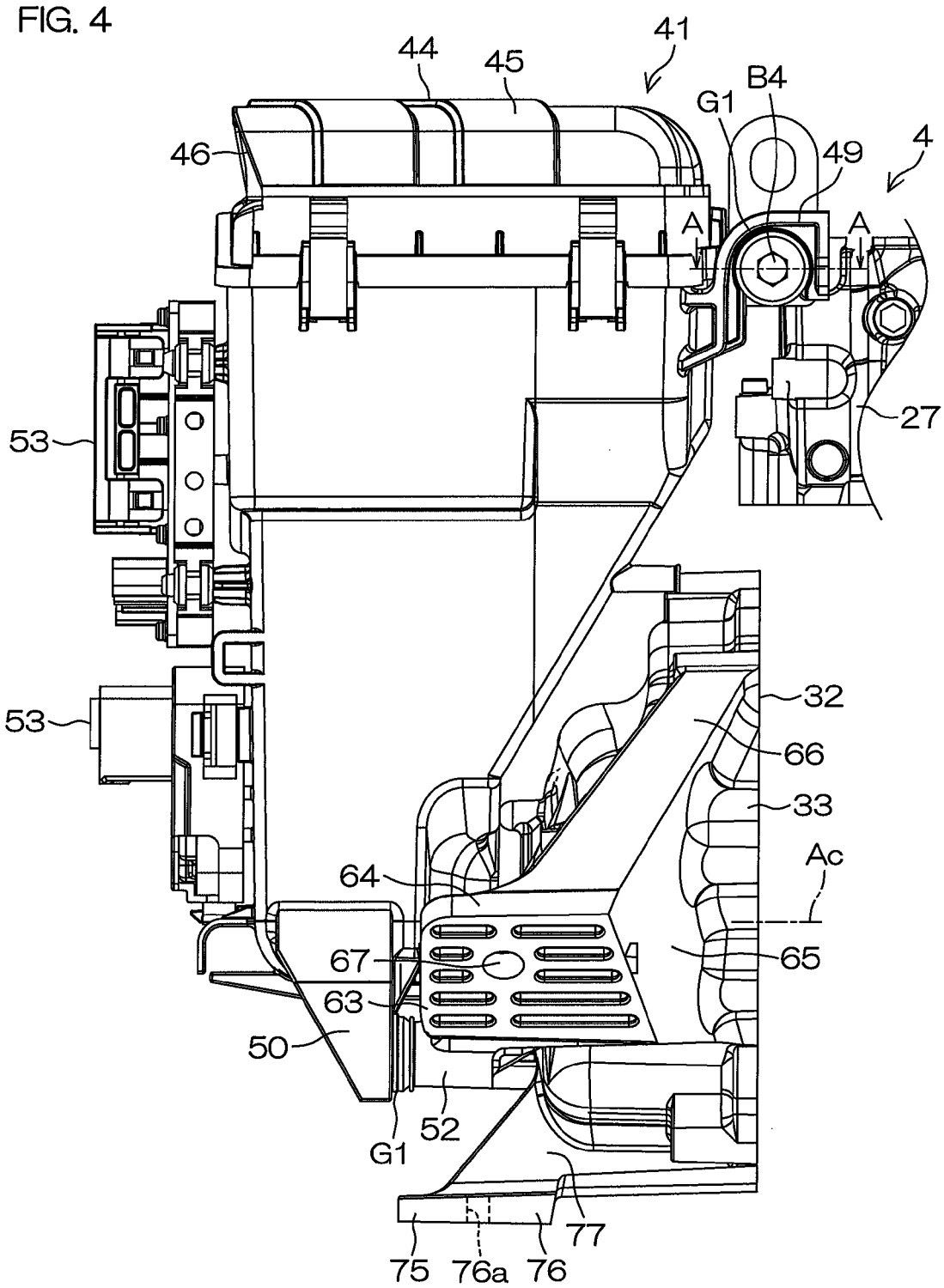
FIG. 4 is a schematic view showing a left side of the case cover and an air intake box.
Figure 5:
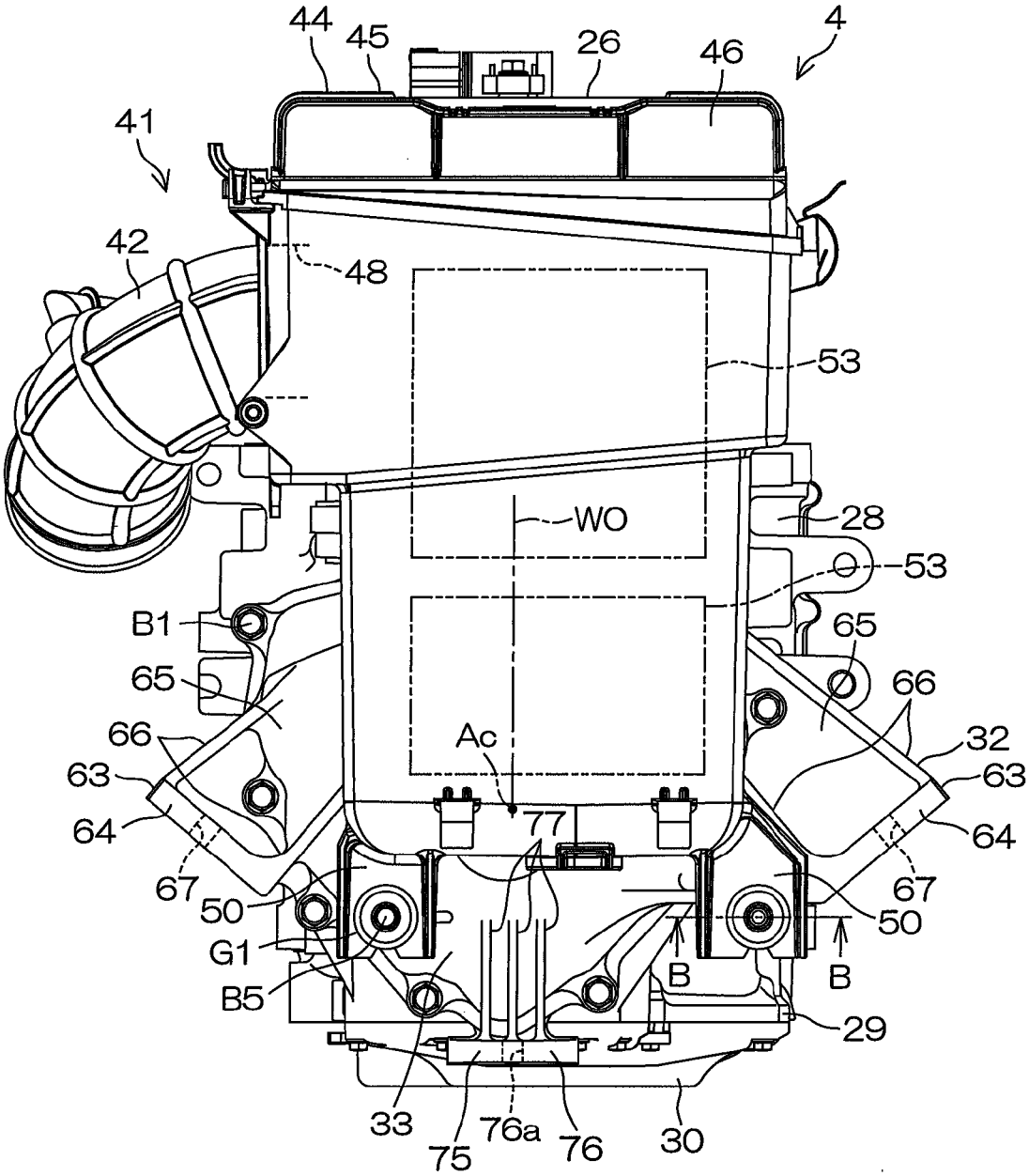
FIG. 5 is a schematic view showing a front of the case cover and the air intake box.

FIG. 4 and FIG. 5 are a left side view and a front view, respectively, of the case cover 32 and the air intake box 44. In FIG. 4 and FIG. 5, a front damper 57 and a front stopper 73, which are described below, are not shown. As shown in FIG. 4 and FIG. 5, the air intake box 44 includes a right-and-left pair of upper arms 49 that extend forwardly from the box body 45 and a right-and-left pair of lower arms 50 that extend downwardly from the box body 45. The pair of upper arms 49 are disposed on the right side and on the left side of the cylinder head 27, respectively. The pair of upper arms 49 are supported by the cylinder head 27. The pair of upper arms 49 are disposed at higher positions than the pair of lower arms 50. The pair of lower arms 50 are disposed in front of the case cover 32. The pair of lower arms 50 are supported by the case cover 32.

Figure 6:
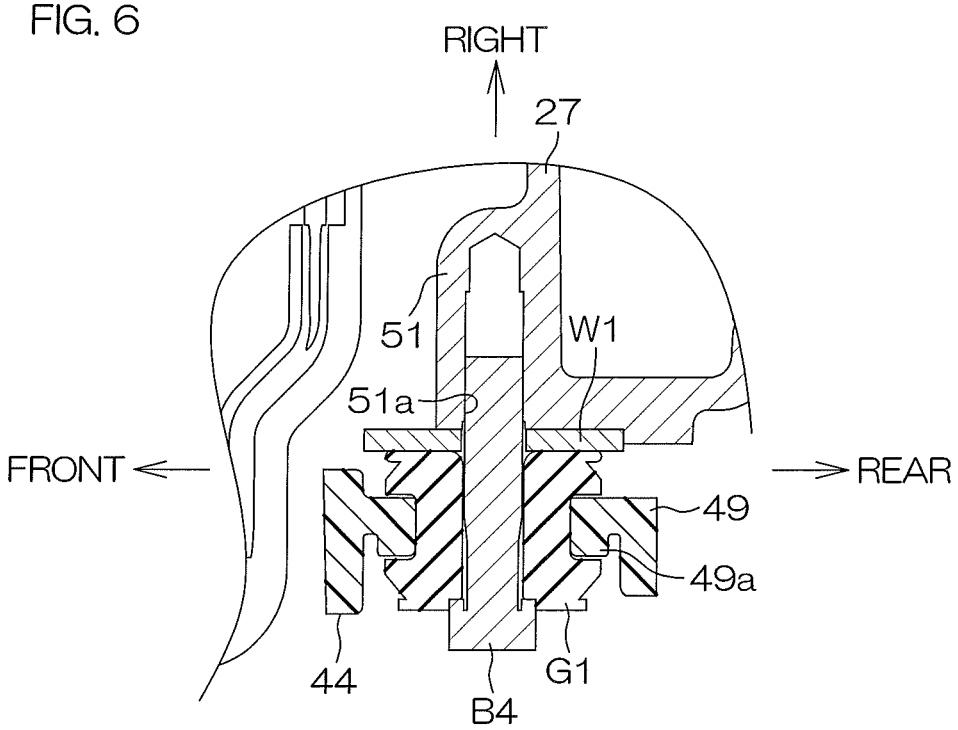
FIG. 6 is a schematic view showing a cross-section taken along line A-A in FIG. 4.

As shown in FIG. 6, the engine 4 includes a cylindrical grommet G1 held by the upper arm 49 and a bolt B4 by which the grommet G1 is fastened to the cylinder head 27. The upper arm 49 includes a cutout portion 49*a* that is downwardly open when viewed laterally. The cutout portion 49*a* is fitted to an annular groove provided in the outer peripheral surface of the grommet G1. The grommet G1 is disposed outside an upper support portion 51 (also see FIG. 9) disposed at the cylinder head 27. A shank of the bolt B4 passes through the grommet G1 in the right-left direction. A head of the bolt B4 is disposed outside the grommet G1. The shank of the bolt B4 is fixed to a female screw hole 51*a* provided in the inner peripheral surface of the upper support portion 51. The grommet G1 is sandwiched in the right-left direction between the upper support portion 51 and the head of the bolt B4. A washer W1 is preferably interposed between the upper support portion 51 and the grommet G1. The grommet G1 is preferably made of an elastic material such as rubber or resin. Therefore, the upper arm 49 is supported by the cylinder head 27 with a vibration-proof member therebetween.

Figure 7:
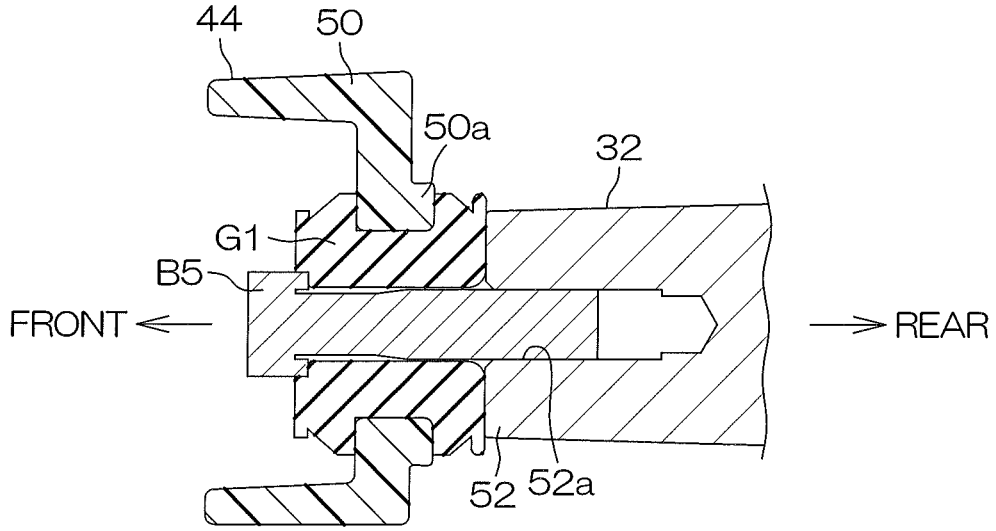
FIG. 7 is a schematic view showing a cross-section taken along line B-B in FIG. 5.

As shown in FIG. 7, the engine 4 includes a cylindrical grommet G1 held by the lower arm 50 and a bolt B5 by which the grommet G1 is fastened to the case cover 32. The lower arm 50 includes a cutout portion 50*a* that is downwardly open when viewed from the front. The cutout portion 50*a* is fitted to an annular groove provided in the outer peripheral surface of the grommet G1. The grommet G1 is disposed in front of a lower support portion 52 disposed at the case cover 32. A shank of the bolt B5 passes through the grommet G1 in the front-rear direction, and a head of the bolt B5 is disposed in front of the grommet G1. The shank of the bolt B5 is fixed to a female screw hole 52*a* provided in the inner peripheral surface of the lower support portion 52. The grommet G1 is sandwiched in the front-rear direction between the lower support portion 52 and the head of the bolt B5. Therefore, the lower arm 50 is supported by the case cover 32 with a vibration-proof member therebetween.

As shown in FIG. 4, the jet propelled watercraft 1 includes an electric component 53 attached to the box body 45 of the air intake box 44. The electric component 53 is disposed in front of the box body 45 of the air intake box 44. The electric component 53 includes at least one of a fuse box, an ECU (electronic control unit), an overturn switch, and a starter unit, for example. The fuse box is an electric component including a plurality of fuses inserted in an electric circuit of the jet propelled watercraft 1. The ECU is an electric component configured or programmed to control an electric apparatus mounted in the jet propelled watercraft 1. The overturn switch is an electric component that detects the overturn (upset) of the jet propelled watercraft 1. The starter unit is an electric component that starts the engine 4. The air intake box 44 supporting the electric component 53 is elastically supported by an engine body via a plurality of grommets G1 defining a vibration-proof member. Therefore, it is possible to significantly reduce vibrations transmitted to the electric component 53.

Figure 8:
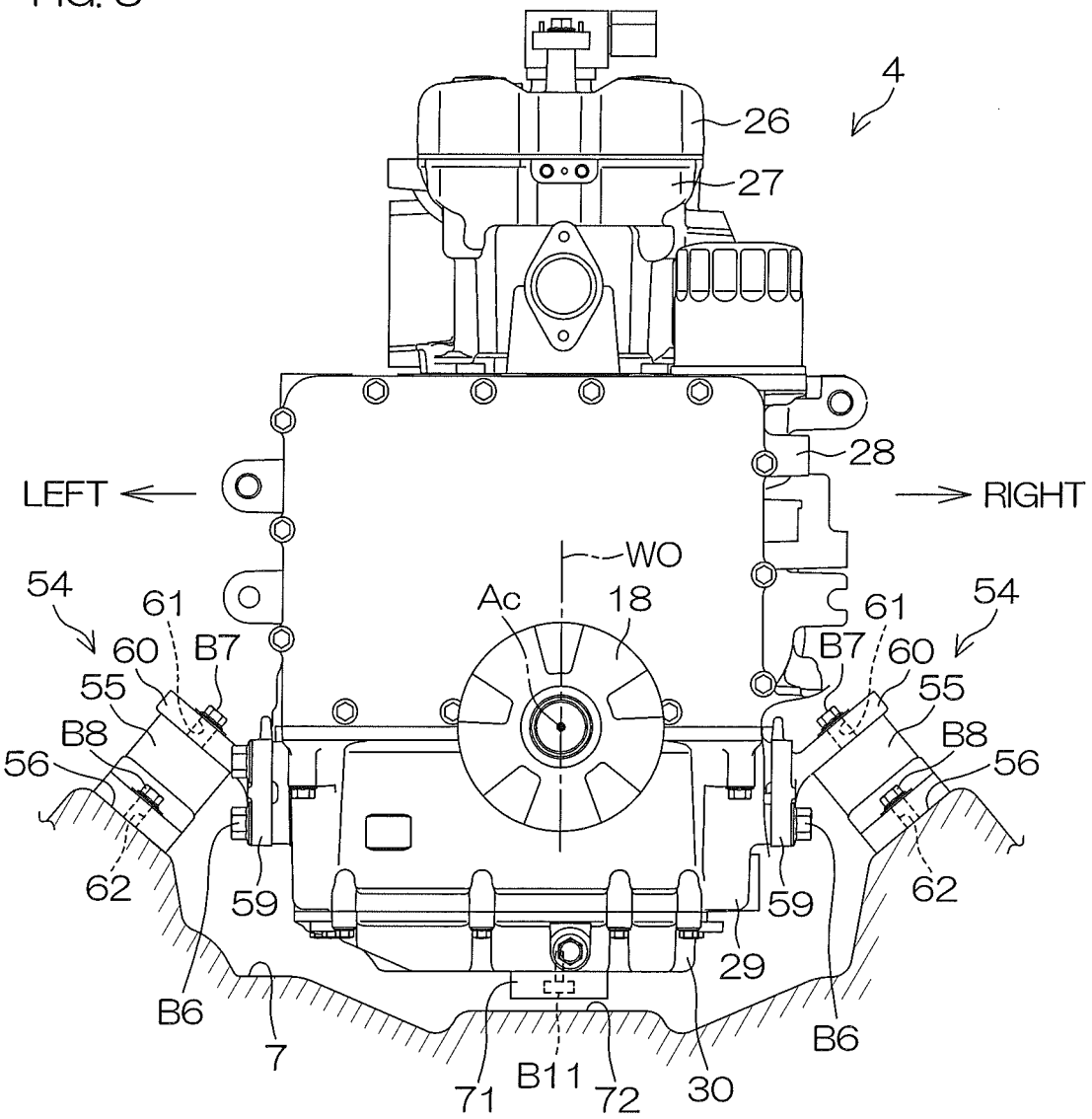
FIG. 8 is a schematic view showing a rear of the engine from which an intake device has been removed.
Figure 9:
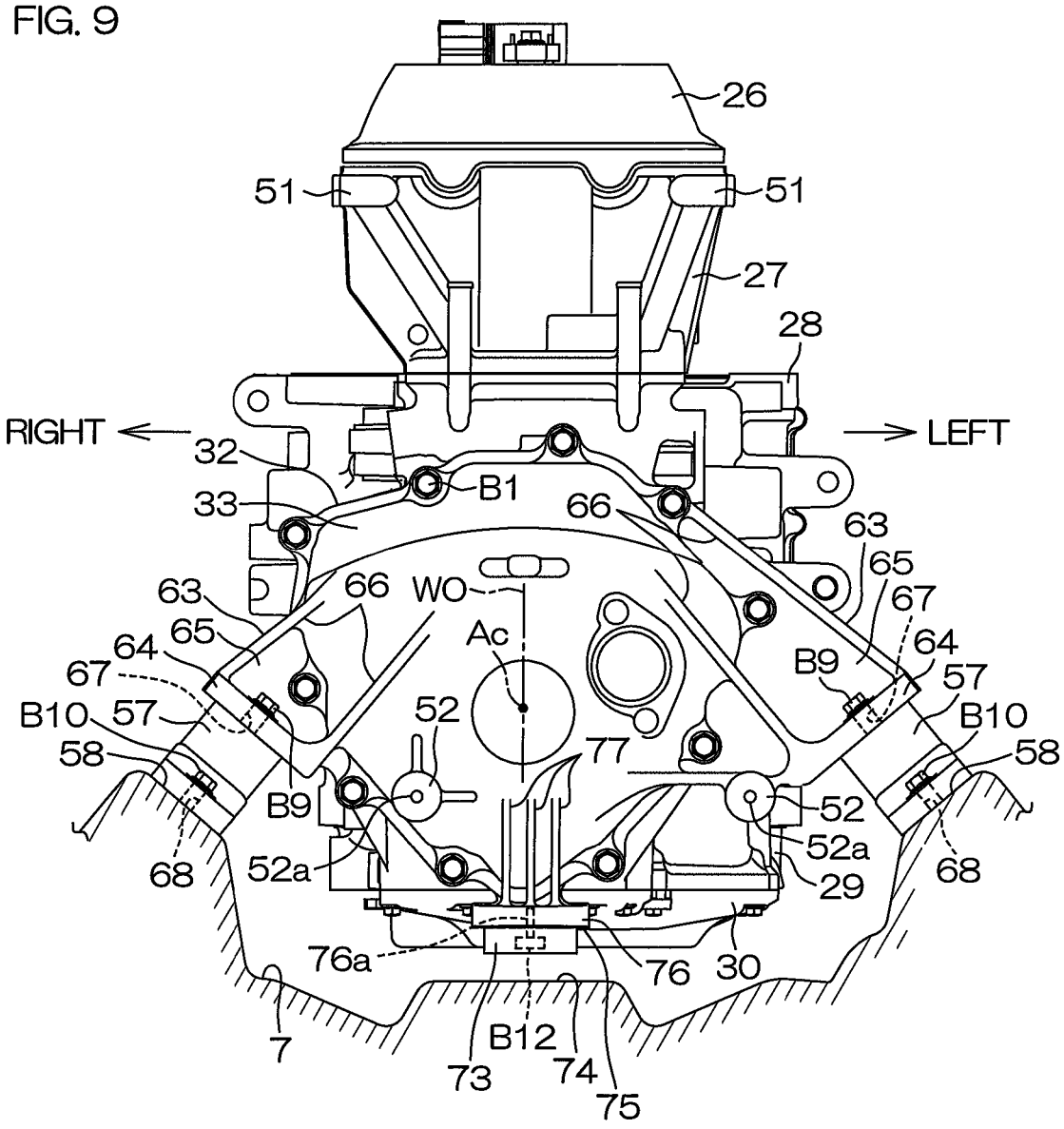
FIG. 9 is a schematic view showing a front of the engine from which the intake device has been removed.

As shown in FIG. 8 and FIG. 9, the engine 4 is supported by the hull 7 via a plurality of dampers (front dampers 57 and rear dampers 55) therebetween. The jet propelled watercraft 1 includes a right-and-left pair of brackets 54 attached to the engine 4, a right-and-left pair of rear dampers 55 attached to both the bracket 54 and the hull 7, and a right-and-left pair of front dampers 57 attached to both the engine 4 and the hull 7. The hull 7 includes a right-and-left pair of rear support portions 56 that support the pair of rear dampers 55 and a right-and-left pair of front support portions 58 that support the pair of front dampers 57. As shown in FIG. 3, the front damper 57 is disposed at a more forward position than the rear damper 55. Both the front dampers 57 and the rear dampers 55 are preferably made of an elastic material such as rubber or resin.

As shown in FIG. 8, the pair of brackets 54 are disposed on the right side and on the left side of the crankcase 29, respectively. The bracket 54 includes a base portion 59 disposed outside the crankcase 29 and an inclined portion 60 that extends outwardly from the base portion 59 and obliquely upward. The base portion 59 is detachably fixed to the crankcase 29 preferably via a plurality of bolts B6. The rear damper 55 is interposed between the inclined portion 60 and the hull 7. A shank of a bolt B7 is inserted from above the inclined portion 60 into a through hole 61 penetrating the inclined portion 60, and is fixed to a nut embedded in the rear damper 55. A shank of a bolt B8 is inserted from above the rear damper 55 into a through hole 62 penetrating the lower portion of the rear damper 55, and is fixed to a nut embedded in the rear support portion 56. Therefore, the crankcase 29 is supported by the hull 7 via the bracket 54 and the rear damper 55.

As shown in FIG. 9, the case cover 32 includes a pair of damper attachment portions 63 to which the pair of front dampers 57 are attached respectively. Each damper attachment portion 63 includes a bottom wall 64 that extends outwardly and obliquely upward when viewed from the front, a rear wall 65 that extends from the rear end of the bottom wall 64 to the wheel housing portion 33, and two side walls 66 that extend from the right and left ends of the bottom wall 64 to the wheel housing portion 33. The front damper 57 is disposed between the bottom wall 64 and the front support portion 58. A shank of a bolt B9 is inserted from above the bottom wall 64 into a through hole 67 penetrating the bottom wall 64, and is fixed to a nut embedded in the front damper 57. A shank of a bolt B10 is inserted from above the front damper 57 into a through hole 68 penetrating the lower portion of the front damper 57, and is fixed to a nut embedded in the front support portion 58. Therefore, the case cover 32 is supported by the hull 7 with the pair of front dampers 57 therebetween.

As shown in FIG. 3, the jet propelled watercraft 1 includes a rear stopper 71 disposed between the engine 4 and the hull 7 and a front stopper 73 disposed between the engine 4 and the hull 7. The hull 7 includes a rear facing portion 72 that faces the rear stopper 71 and a front facing portion 74 that faces the front stopper 73. The front stopper 73 is disposed at a more forward position than the rear stopper 71. Both the front stopper 73 and the rear stopper 71 are preferably made of an elastic material such as rubber or resin.

As shown in FIG. 8, the rear stopper 71 is disposed below the oil pan 30. The rear stopper 71 intersects with the body center WO. The rear stopper 71 is attached to the oil pan 30 via a bolt B11. A shank of the bolt B11 is inserted into the rear stopper 71 from below the rear stopper 71, and is fixed to a female screw hole provided in the oil pan 30. Ahead of the bolt B11 is disposed at a height between the lower surface of the rear stopper 71 and the lower surface of the oil pan 30. The flat lower surface of the rear stopper 71 faces the upper surface of the rear facing portion 72 of the hull 7 across a space therebetween in the up-down direction. As shown in FIG. 3, the rear stopper 71 is disposed at a more rearward position than the foremost cylinder 23. The rear stopper 71 is disposed at a lower position than the rear damper 55.

Figure 10:
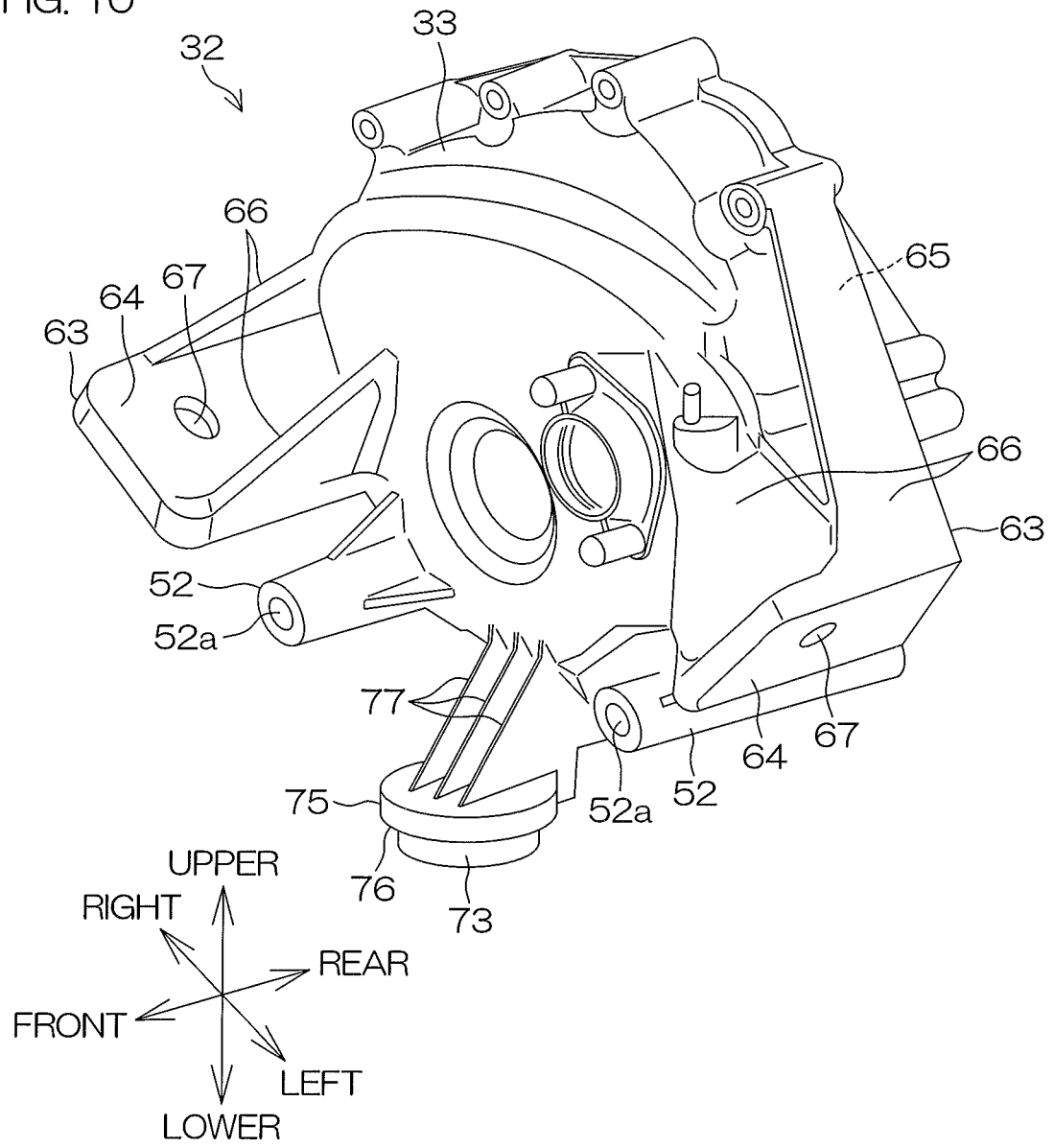
FIG. 10 is a perspective front view of the case cover seen obliquely from above and from the left.

As shown in FIG. 9 and FIG. 10, the case cover 32 includes a stopper attachment portion 75 to which the front stopper 73 is attached. The stopper attachment portion 75 includes a bottom wall 76 that extends in the right-left direction when viewed from the front and a plurality of longitudinal walls 77 that extend upwardly from the upper surface of the bottom wall 76 to the wheel housing portion 33. The longitudinal walls 77 are disposed parallel or substantially parallel with each other with a space therebetween in the right-left direction. The right and left ends of the bottom wall 76 are disposed at more outward positions than each longitudinal wall 77. The front end of the bottom wall 76 is disposed at a more forward position than each longitudinal wall 77. The bottom wall 76 intersects with the body center WO. The bottom wall 76 is disposed at a lower position than the crankcase 29. The bottom wall 76 is positioned in front of the oil pan 30, and overlaps with the oil pan 30 when viewed from the front.

As shown in FIG. 9, the front stopper 73 is disposed below the bottom wall 76 of the stopper attachment portion 75. The front stopper 73 intersects with the body center WO. The front stopper 73 is attached to the stopper attachment portion 75 preferably by a bolt B12, for example. A shank of the bolt B12 is inserted from below the front stopper 73 into a through hole penetrating the front stopper 73 in the up-down direction, and is fixed to a female screw hole 76*a* provided in the bottom wall 76 of the stopper attachment portion 75. A head of the bolt B12 is disposed at a height between the lower surface of the front stopper 73 and the lower surface of the bottom wall 76. The flat lower surface of the front stopper 73 faces the upper surface of the front facing portion 74 of the hull 7 across a space therebetween in the up-down direction. The front stopper 73 is disposed at a lower position than the front damper 57. The front end of the front stopper 73 is disposed at a more forward position than the front end of the front damper 57.

The stopper attachment portion 75 preferably is integral and unitary with the wheel housing portion 33, with the lower support portion 52, and with the damper attachment portion 63. As shown in FIG. 4, the stopper attachment portion 75 extends forwardly from the wheel housing portion 33. The female screw hole 76*a* of the stopper attachment portion 75 is disposed at a more forward position than the wheel housing portion 33. The stopper attachment portion 75 is disposed at a lower position than the crankshaft axis Ac. The bottom wall 76 of the stopper attachment portion 75 is disposed at a lower position than the lower support portion 52 and the damper attachment portion 63. The longitudinal wall 77 of the stopper attachment portion 75 is disposed at a lower position than the damper attachment portion 63. The lower support portion 52 is disposed at a lower position than the through hole 67 of the damper attachment portion 63. As shown in FIG. 9, the lower support portion 52 is disposed at a more outward position than the stopper attachment portion 75. Likewise, the damper attachment portion 63 is disposed at a more outward position than the lower support portion 52.

As described above, in the present preferred embodiment, the front stopper 73 preferably made of an elastic material is disposed between the hull 7 and the engine 4. The front stopper 73 faces the hull 7 across a space therebetween in the up-down direction. The front stopper 73 is attached to the stopper attachment portion 75 that is integral and unitary with the case cover 32. Therefore, a structurally independent member by which the front stopper 73 is attached to the engine 4 is unnecessary, and it is possible to reduce the number of components and the number of assembling process steps. Additionally, such a member is unnecessary, and thus, it is possible to prevent components, such as the engine 4, that are housed in the hull 7 from being enlarged.

Additionally, in the present preferred embodiment, the engine 4 is supported by the hull 7 via a plurality of dampers (front dampers 57 and rear dampers 55) disposed at four places spaced in the frontward, rearward, rightward, and leftward directions. Additionally, the engine 4 is connected to the jet pump 3 disposed behind the engine 4 via the coupling 18. Therefore, it is more difficult for the rear end of the engine 4 to move in the vertical direction with respect to the hull 7 than the front end of the engine 4. The front stopper 73 is disposed at a more forward position than the flywheel 31. In other words, the front stopper 73 is disposed near the front end of the engine 4 that is more easily moved compared to the rear end of the engine 4. Therefore, it is possible to significantly reduce the movement of the engine 4 with respect to the hull 7.

Additionally, in the present preferred embodiment, the stopper attachment portion 75 extends forwardly from the wheel housing portion 33 of the case cover 32, and at least one portion of the stopper attachment portion 75 is disposed at a more forward position than the wheel housing portion 33. Therefore, the front stopper 73 and the stopper attachment portion 75 are disposed near the front end of the engine 4 that is more easily moved compared to the rear end of the engine 4. Therefore, it is possible to significantly reduce the movement of the engine 4 with respect to the hull 7.

Additionally, in the present preferred embodiment, the stopper attachment portion 75 is disposed at a more forward position than the crankcase 29, and thus, it is possible to increase the distance from the gravity center of the engine 4 to the front stopper 73 in the front-rear direction. When the distance from the gravity center of the engine 4 to the front stopper 73 is great, it is possible to reduce the movement of the engine 4 with a smaller force. Therefore, it is possible to more reliably reduce the movement of the engine 4 with respect to the hull 7.

Additionally, in the present preferred embodiment, the intake device 41 is supported by the lower support portion 52 of the case cover 32. Therefore, not only the mass of the case cover 32 but also the mass of the intake device 41 is applied to the case cover 32. The stopper attachment portion 75 is integral and unitary with the lower support portion 52 of the case cover 32. Therefore, the front stopper 73 is attached to a portion to which a comparatively great inertia force is applied when the jet propelled watercraft 1 rapidly moves in the up-down direction during traveling. Therefore, it is possible to prevent a great shock from hitting the hull 7 when the engine 4 comes into contact with the hull 7 via the front stopper 73.

Although preferred embodiments of the present invention have been described above, the present invention is not restricted to the contents of the preferred embodiments and various modifications are possible within the scope of the present invention.

For example, in the preferred embodiments described above, the stopper attachment portion 75 is preferably integral and unitary with the case cover 32. However, the stopper attachment portion 75 may be integral and unitary with the oil pan 30, or may be integral and unitary with the crankcase 29. Additionally, the oil pan 30 may be excluded.

In a preferred embodiment of the present invention, the stopper attachment portion 75 is preferably disposed at a more forward position than the crankcase 29. However, the stopper attachment portion 75 may be disposed below the flywheel 31 or below the crankcase 29, or may be disposed at a more rearward position than the flywheel 31. The front stopper 73 may also be disposed in the same manner as the stopper attachment portion 75.

In a preferred embodiment of the present invention, the stopper attachment portion 75 is preferably integral and unitary with the wheel housing portion 33, with the lower support portion 52, and with the damper attachment portion 63. However, two or more of the wheel housing portion 33, the lower support portion 52, and the damper attachment portion 63 may be separate members from the stopper attachment portion 75. Additionally, the lower support portion 52 supporting the air intake box 44 may be excluded from the case cover 32.

In a preferred embodiment of the present invention, the electric component 53 is preferably supported by the air intake box 44, and the air intake box 44 is preferably elastically supported by the cylinder head 27 and so forth via the grommets G1 each of which define a vibration-proof member. However, if the electric component 53 is not supported by the air intake box 44, the air intake box 44 may be supported by the cylinder head 27 and so forth without vibration-proof members. Additionally, the air intake box 44 may be supported by a member, such as the hull 7, other than the engine body.

In a preferred embodiment of the present invention, the jet propelled watercraft 1 is preferably a personal watercraft including the saddle type seat 6. However, the jet propelled watercraft 1 may be a jet propelled watercraft other than a personal watercraft. For example, the jet propelled watercraft 1 may be a jet boat.

Also, features of two or more of the various preferred embodiments described above may be combined.

The present application claims priority to Japanese Patent Application No. 2014-158129 filed on Aug. 1, 2014 in the Japan Patent Office, and the entire disclosure of which is incorporated herein by reference in its entirety.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled watercraft comprising:

a jet pump configured to jet water rearwardly;

an engine configured to drive the jet pump and including a crankshaft configured to rotate around a crankshaft axis, a crankcase housing the crankshaft, a case cover attached to the crankcase, and a stopper attachment portion integral and unitary with the crankcase or with the case cover;

a hull housing the engine; and a stopper disposed between the hull and the engine, the stopper facing the hull in an up-down direction across a space between the stopper and the hull, the stopper being made of an elastic material, the stopper being attached to the stopper attachment portion, the stopper being an integral and unitary member, and the stopper being disposed at a more forward position than the crankcase.

2. The jet propelled watercraft according to claim 1, wherein the engine further includes a flywheel configured to rotate around the crankshaft axis together with the crankshaft, the case cover includes a wheel housing portion housing the flywheel, and the stopper attachment portion is integral and unitary with the wheel housing portion.

3. The jet propelled watercraft according to claim 2, wherein the stopper is disposed at a more forward position than the flywheel.

4. The jet propelled watercraft according to claim 2, wherein the stopper attachment portion extends forwardly from the wheel housing portion.

5. The jet propelled watercraft according to claim 1, wherein the stopper attachment portion is disposed at a more forward position than the crankcase.

6. A jet propelled watercraft comprising:

a jet PUMP configured to jet water rearwardly;

an engine configured to drive the jet pump and including a crankshaft configured to rotate around a crankshaft axis, a crankcase housing the crankshaft, a case cover attached to the crankcase, and a stopper attachment portion integral and unitary with the crankcase or with the case cover;

a hull housing the engine;

a stopper disposed between the hull and the engine, the stopper facing the hull in an up-down direction across a space between the stopper and the hull, the stopper being made of an elastic material, and the stopper being attached to the stopper attachment portion; and a damper attached to both the hull and the engine; wherein the case cover includes a damper attachment portion to which the damper is attached; and the stopper attachment portion is integral and unitary with the damper attachment portion.

7. The jet propelled watercraft according to claim 1, wherein the engine further includes an intake device configured to supply air to a combustion chamber;

the case cover includes a support portion supporting the intake device; and the stopper attachment portion is integral and unitary with the support portion.

8. The jet propelled watercraft according to claim 7, wherein the intake device includes an air intake box containing an air filter, and a portion of the air intake box is supported by the support portion of the case cover.

9. The jet propelled watercraft according to claim 1, wherein the stopper is made entirely of the elastic material.

* * * * *